US007316502B2

(12) United States Patent
Freeman

(10) Patent No.: US 7,316,502 B2
(45) Date of Patent: Jan. 8, 2008

(54) MIXING BLADE, BLENDING APPARATUS, AND METHOD OF MIXING

(76) Inventor: Richard Freeman, 11 S. Marion St., Warren, PA (US) 16365

( * ) Notice: Subject to any disclaimer, the term of this patent is extended or adjusted under 35 U.S.C. 154(b) by 287 days.

(21) Appl. No.: 11/104,919

(22) Filed: Apr. 13, 2005

(65) Prior Publication Data

US 2006/0233044 A1 Oct. 19, 2006

(51) Int. Cl.
*B01F 7/26* (2006.01)

(52) U.S. Cl. ..... 366/316; 366/317; 416/228; 416/231 A; 416/241 A

(58) Field of Classification Search ..... 366/315–317; 241/93, 293, 296, 191; 416/241 A, 228, 416/231 R, 231 A, 231 B
See application file for complete search history.

(56) References Cited

U.S. PATENT DOCUMENTS

| | | | | |
|---|---|---|---|---|
| 2,115,997 | A * | 5/1938 | Morse | 416/185 |
| 2,673,077 | A * | 3/1954 | Messbauer | 416/185 |
| 2,692,127 | A | 10/1954 | Conn | |
| 3,044,750 | A * | 7/1962 | Schmitt, Jr. | 416/184 |
| 3,376,024 | A * | 4/1968 | Beechler et al. | 416/183 |
| 3,402,897 | A * | 9/1968 | Willems | 241/46.01 |
| 3,462,131 | A * | 8/1969 | Hill | 366/176.1 |
| 3,606,577 | A * | 9/1971 | Conn | 416/181 |
| 4,171,166 | A * | 10/1979 | Trowbridge et al. | 366/316 |
| 4,534,657 | A * | 8/1985 | Clement | 366/265 |
| 4,589,778 | A * | 5/1986 | Mitchell | 366/316 |
| 4,813,787 | A * | 3/1989 | Conn | 366/296 |
| 5,201,635 | A * | 4/1993 | Steinmetz | 416/228 |
| 5,292,193 | A * | 3/1994 | Funk | 366/307 |
| 5,797,728 | A * | 8/1998 | Frith | 416/231 A |
| 6,575,616 | B2 * | 6/2003 | D'Agostino | 366/316 |
| 2006/0233044 | A1 * | 10/2006 | Freeman | 366/316 |

FOREIGN PATENT DOCUMENTS

JP 6-63372 * 3/1994

OTHER PUBLICATIONS

Genuine Cowles Impellers from MorehouseCowles, printed from www.morehousecowles.com, pp. 1-2, date unknown.
Disperson Blades from Indco Mixing Equipment, printed from www.indco.com, pp. 1-13, date unknown.

* cited by examiner

*Primary Examiner*—Charles E. Cooley
(74) *Attorney, Agent, or Firm*—Greenblum & Bernstein, P.L.C.

(57) ABSTRACT

A blade for mixing a material includes a disk comprising a plastic or composite material. The disk may have one or more circumferentially-spaced openings extending through the disk from a substantially flat top surface to a substantially flat bottom surface. The openings are located at a common radial distance from a center of the disk. The disk may be made from a plastic material such as nylon, Teflon®, polyethylene, polyurethane, polyvinyl chloride, or combinations thereof. The disk may also have one or more sets of mixing teeth extending outwardly from a circumferential edge of the disk. A blending apparatus includes one or more of the disks mounted on a rotatable shaft.

22 Claims, 5 Drawing Sheets

MIXING BLADE, BLENDING APPARATUS, AND METHOD OF MIXING

BACKGROUND OF THE INVENTION

The present invention relates to mixing blades. In particular, the present invention is directed to mixing blades comprising a plastic or composite material, a blending apparatus using such a blade, and methods of mixing with such blades.

Material blenders are exemplified by such devices as disclosed in U.S. Pat. No. 2,692,127 to Conn. U.S. Pat. No. 2,692,127 discloses a blender comprising a disk adapted to rotate about an axis. The disk has circumferentially-spaced openings or radial slits extending therethrough. As shown in FIGS. 1-3, the portion of the disk on one side of each slit is pressed upwardly to form a hood 18 and an opening 20 through which material is propelled when the disk is rotated. Deflectors 22 extend outwardly from the opposite side of the hoods 18 in advance of the openings 20. The structure of the blender and the disk are incorporated herein by reference in their entirety.

U.S. Pat. No. 3,606,577 to Conn discloses a double-blade cutting and blending rotor consisting of a pair of axially-spaced, symmetrically oppositely-designed circular blades. The blades have impeller cups and vertical or inclined peripheral material-cutting teeth. The peripheral teeth may alternate in an up-and-down pattern. As a group, the teeth may be inclined relative to the plane of the disk at angles varying over a wide range. Thus, in FIG. 4, mixing teeth are disclosed which angle at an inclination to the plane of the disk approximately 45 degrees. The structure of the circular blades and the blending apparatus are incorporated herein by reference in their entirety.

U.S. Pat. No. 4,813,787 to Conn discloses a blending apparatus having a rotor provided with louvers and mixing teeth. The louvers have openings that vary in size and act to convey materials, which are being cut and blended, through the disk. Adjacent mixing teeth extend from the peripheral edges of the rotor and vary in angular extension. The structure of the rotor is incorporated herein by reference in its entirety.

Mixing blades or disks are generally made from metal. As a result of aggressive blending, the metal blades, particularly louvers, hoods, and mixing teeth, are prone to rapid wear and need to be replaced often.

The mixing blade of the present invention comprises a disk comprising a plastic or composite material. The blade has a longer working life than conventional metal blades, thereby providing a substantial savings in replacement and repair costs while also blending and mixing materials effectively. The disk has one or more openings or slots extending through the disk from a substantially flat top surface to a substantially flat bottom surface. The disk may also have one or more sets of mixing teeth located along its circumferential edge.

SUMMARY OF THE INVENTION

According to the present invention, a blade for mixing, blending, or masticating a material comprises a disk comprising a plastic or composite material. The plastic or composite material is abrasion-resistant, thereby providing a longer working life as compared to a metal blade.

The disk has one or more openings or slots which extend through the disk from a substantially flat top surface to a substantially flat bottom surface. The openings may be circumferentially-spaced. The openings may vary in size and shape depending upon the mixing needs of a particular material. In embodiments, the length of the openings may be, for example, from about 20% of the disk radius to about 95% of the disk radius. One or both sides of each opening may have two sections: a lead-in section that is angled in relation to an axis perpendicular to the substantially flat top surface of the disk, and a section following the lead-in section having an angle greater than that of the lead-in section.

One or more sets of mixing teeth may be located along the circumferential edge of the disk. The mixing teeth extend outwardly from the circumferential edge of the disk. In embodiments, the one or more sets of mixing teeth may be offset from one another. The one or more sets of mixing teeth may vary in angular inclination in relation to an axis perpendicular to the substantially flat top surface of the disk. The disk does not have any louvers or hoods.

According to the present invention, the disk may have a center hole or opening so it can be mounted on a rotatable shaft. A blending apparatus may have one or more disks mounted on a rotatable shaft. When the shaft is rotated, the one or more disks are rotated therewith. During rotation of a disk, the one or more openings provide a pumping action that moves the material through the one or more openings and outwards toward the edge of the disk. If present, the one or more sets of mixing teeth catch the outwardly moving material to further mix, blend, or masticate the material.

DETAILED DESCRIPTION OF THE INVENTION

Figure 1:
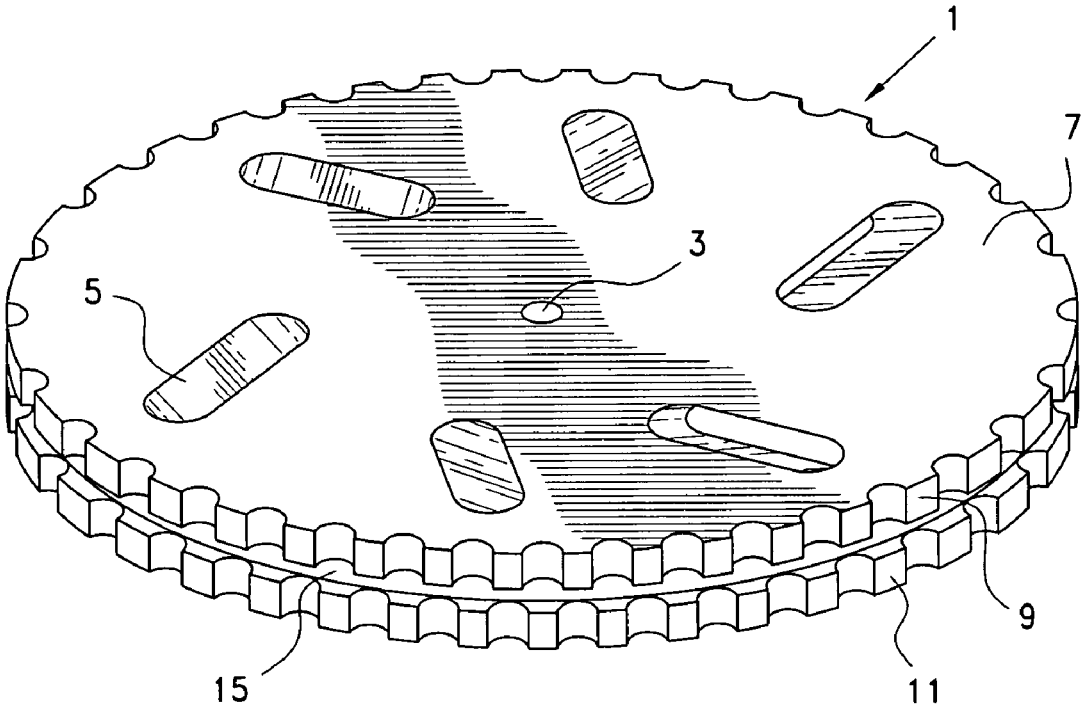
FIG. 1 is a perspective view of a blade according to a first embodiment of the present invention.

According to the present invention, a blade for mixing, blending, or masticating a material comprises a plastic or composite material. In embodiments, the blade may be a round, flat disk having a substantially flat top surface and a substantially flat bottom surface. The plastic or composite material may be any kind of abrasion-resistant material. In embodiments, the plastic material includes, but is not limited to, nylon, Teflon®, polyethylene, polyurethane, polyvinyl chloride, or combinations thereof. The composite material may be, but is not limited to, a combination of at least two different materials selected from the group consisting of a metal, a ceramic, a polymer, a glass, and combinations thereof. The blade of the present invention provides a longer working life for mixing, blending, or masticating a variety of materials as compared to using a metal blade.

The mixing blade of the present invention may be used to blend, mix, or masticate a variety of materials. In embodiments, the material may be at least one material including, but not limited to, inks, paints, adhesives, chemicals, polyurethanes, sealers, slurries, grouts, or food products. In addition, the material may be a fluid material comprising aggregates, powders, or other additives.

The disk may have one or more openings or slots extending from the substantially flat top surface of the disk through to the substantially flat bottom surface of the disk. The one or more openings may be circumferentially-spaced. In embodiments, the openings may be arranged circumferentially on the disk at evenly-spaced intervals, for example, at about 10 degree to about 60 degree intervals. The openings may also be radially-aligned, having common radial distances from the center of the disk. The size and shape of the openings may vary depending upon the mixing needs of a particular material. In embodiments, the openings may extend about 20% of the disk radius to about 95% of the disk radius.

Each side of the openings may be angled with respect to an axis perpendicular to the substantially flat top surface of the disk. In embodiments, one or both sides of the openings may comprise two sections having different angles. Thus, for example, one side of an opening may have a lead-in section which has a lead-in angle which gradually slopes from a top side or bottom side of the disk, followed by a section having an angle greater than the lead-in angle. The lead-in section helps provide a pumping action for forcing a material through the opening when the blade is in use.

According to the present invention, the disk may have one or more sets of mixing teeth located along the circumferential edge of the disk. In embodiments, the one or more sets of mixing teeth extend outwardly from the circumferential edge of the disk.

In an embodiment of the mixing blade according to the present invention, the disk has two sets of mixing teeth. One set of mixing teeth extends outwardly from the circumferential edge of the disk from the top surface of the disk. A second set of mixing teeth extends outwardly from the circumferential edge from the bottom surface of the disk. A groove or channel may run around the circumference of the disk between the two sets of teeth. The groove allows for interruption of material flow, thereby providing for aggressive mixing when the disk is in use. In embodiments, the space between successive teeth in each set of mixing teeth may be scalloped. In addition, the one or more sets of mixing teeth may be offset from one another.

In a second embodiment of the mixing blade according to the present invention, one or more sets of mixing teeth may vary in angular inclination in relation to an axis perpendicular to the substantially flat top surface of the disk. The one or more sets of mixing teeth may be at an angle of less than about 45 degrees, for example about 10 degrees to about 30 degrees, in relation to an axis perpendicular to the substantially flat top surface of the disk. As the angle of the mixing teeth is increased, more aggressive mixing, blending, or masticating of a material occurs.

In a third embodiment of the blade according to the present invention, the disk may not have any mixing teeth, so that the circumferential edge of the disk is substantially smooth.

FIG. 1 shows a mixing blade according to a first embodiment of the present invention. The mixing blade is a flat and round disk 1 having a opening 3 for mounting on a shaft. The disk 1 has circumferentially-spaced openings or passageways 5 extending from a substantially flat top surface 7 to a substantially flat bottom surface. The openings 5 are radially-aligned, having common radial distances from the center of the disk.

Figure 2:
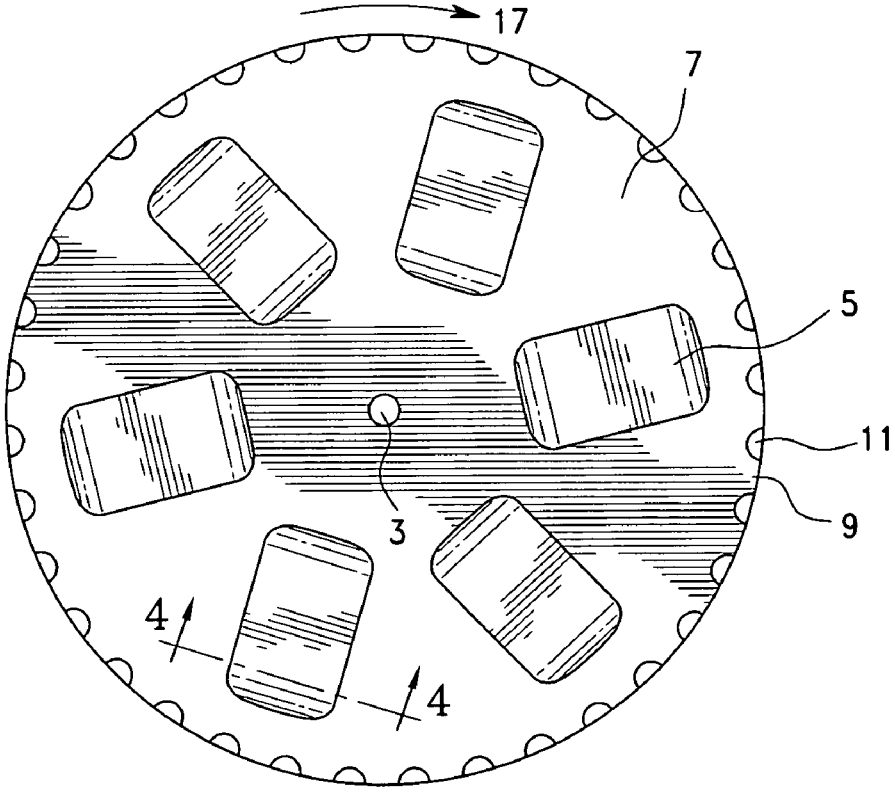
FIG. 2 is a top view of the blade shown in FIG. 1.
Figure 3:
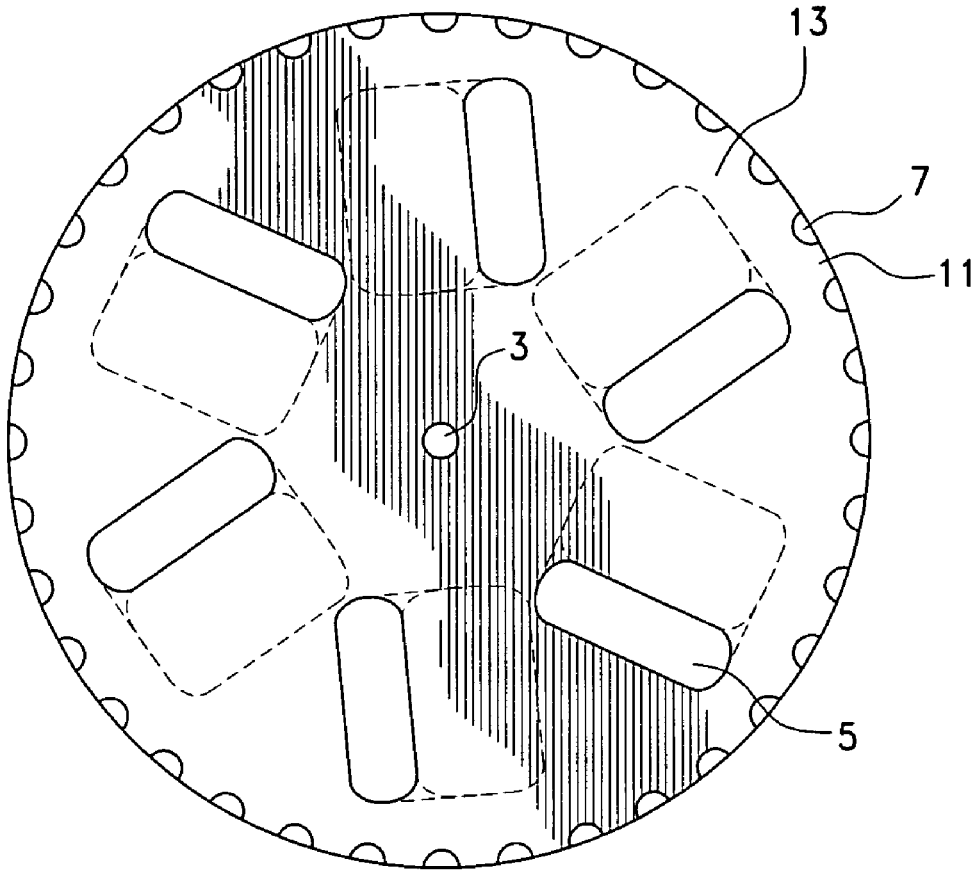
FIG. 3 is a bottom view of the blade shown in FIG. 1.

On the circumferential or peripheral edge of disk 1, there are located two sets of mixing teeth. One set of mixing teeth 9 extends outwardly from the circumferential edge from the top surface 7 of the disk, as shown in FIGS. 1-2. The other set of mixing teeth 11 extends outwardly from the circumferential edge from the bottom surface 13 of the disk, as shown in FIG. 1 and FIG. 3. The space between successive teeth in each set of mixing teeth 9, 11 is scalloped. The two sets of mixing teeth 9, 11 are separated by a central groove or channel 15 running around the circumference of disk 1 between the two sets of mixing teeth.

As shown in FIG. 2 and FIG. 3, the two sets of mixing teeth 9, 11 are offset from one another, such that the mixing teeth 11 are oriented between the mixing teeth 9 or vice versa.

Figure 4:
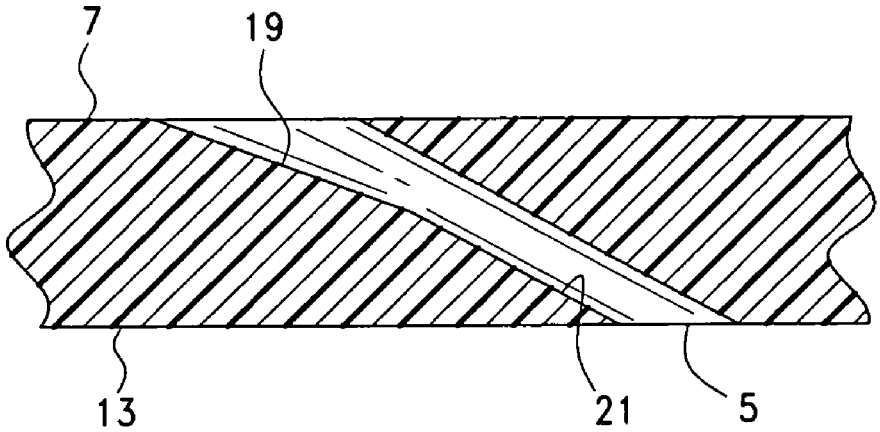
FIG. 4 is cross-sectional view taken along line 4-4 of FIG. 2.

As shown in FIG. 4, one side of the openings 5 has a lead-in section 19, which has a lead-in angle extending from a top surface 7 of the disk, followed by section 21 having an angle greater than the lead-in angle of lead-in section 19 and continuing to the bottom surface 13 of the disk.

The disk 1 may rotate clockwise in the direction of arrow 17, as shown in FIG. 2. As the disk rotates, the material which is being mixed, blended, or masticated is drawn downwardly through the openings 5 by a pumping action, and pushed outwardly towards the periphery of the disk. The mixing teeth 9, 11 catch the material and push it up the edge of the disk towards the top surface 7. In operation there are additional material flow movements, for example, some material slides laterally from the top surface 7 of the disk down through the mixing teeth 9, 11.

If disk 1 must be rotated in a counterclockwise direction, for example, because the rotation of the shaft to which it is to be attached cannot rotate in a clockwise direction, then disk 1 may be made in a left-hand embodiment in which the orientation of the openings is reversed as compared to the openings 5 in disk 1, which is a right-hand disk.

Figure 5:
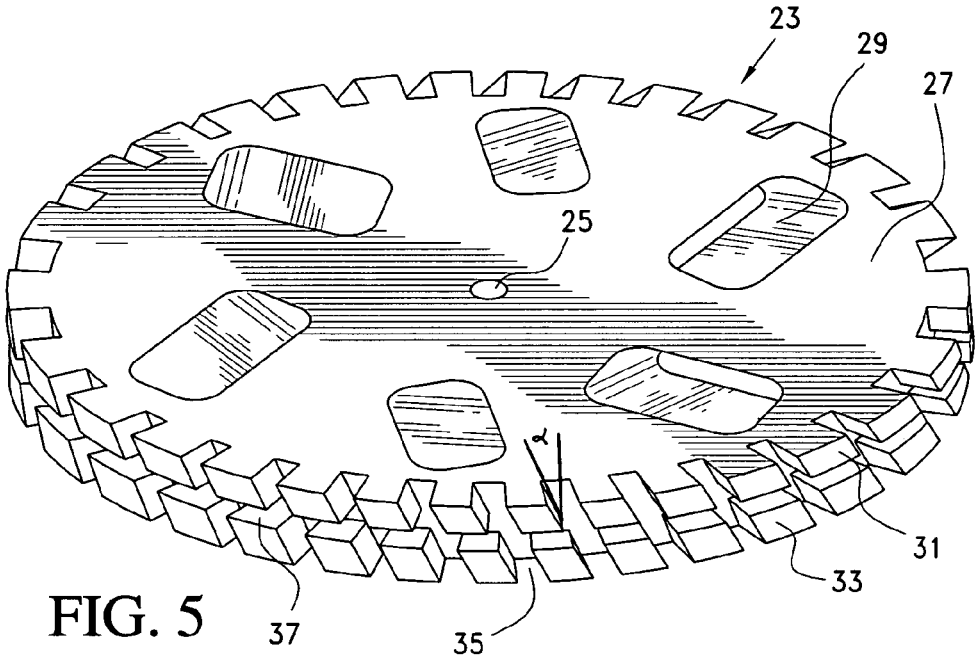
FIG. 5 is a perspective view of a second embodiment of a blade according to the present invention.

A second embodiment of the mixing blade according to the present invention is shown in FIG. 5. Disk 23 is a flat and round disk having a opening 25 for mounting on a shaft. The top surface 27 has circumferentially-spaced and radially-aligned openings 29.

Figure 6:
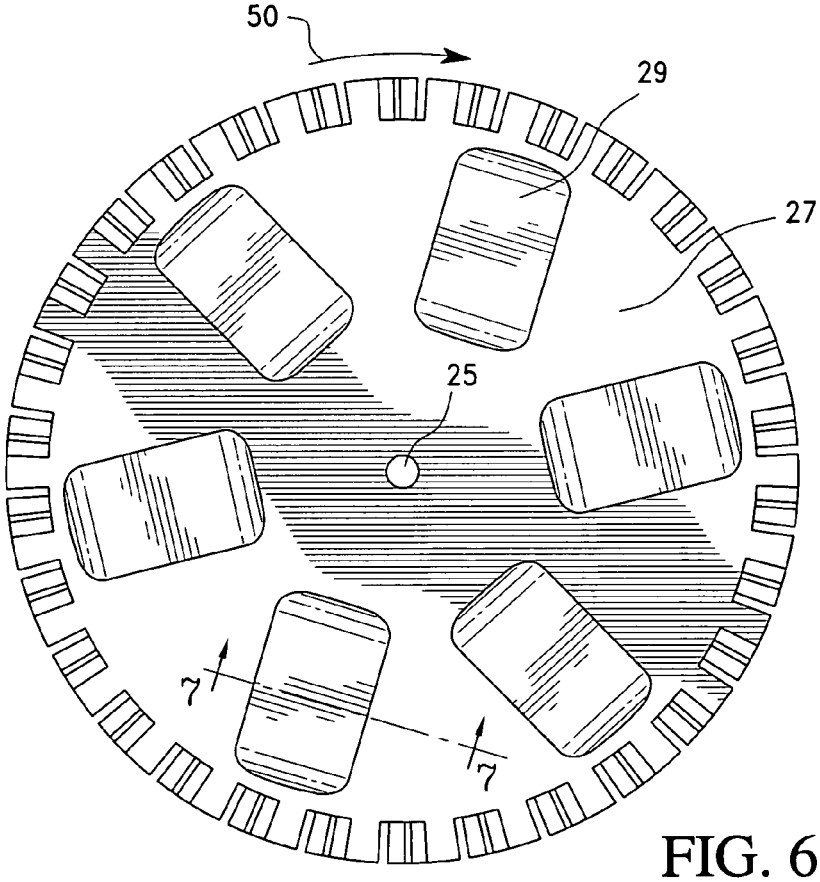
FIG. 6 is a top view of the blade shown in FIG. 5.

On the circumferential or peripheral edge of disk 23 there are located two sets of mixing teeth. One set of mixing teeth 31 extends outwardly from the circumferential edge from top surface 27 of the disk 23, as shown in FIGS. 5-6. The other set of mixing teeth 33 extends outwardly from the circumferential edge from the bottom surface 35 of the disk 23, as shown in FIG. 5. The two sets of mixing teeth 31, 33 are separated by a gap 37. The two sets of mixing teeth are offset an angle ($\alpha$) of about 30 degrees in relation to an axis perpendicular to the substantially flat top surface of the disk.

Figure 7:
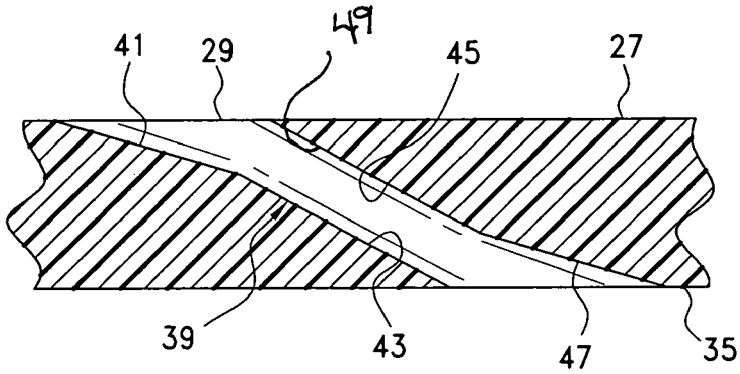
FIG. 7 is cross-sectional view taken along line 7-7 of FIG. 6.

As shown in FIG. 7, one side 39 of the openings 29 has a lead-in section 41 having a lead-in angle extending from top surface 27. Lead-in section 39 is followed by a section 43, which has an angle greater than the lead-in angle of lead-in section 41 and extending to bottom surface 35 of disk 23. Similarly, the opposite side 45 of the opening 29 has a lead-in section 47 having a lead-in angle extending from the bottom surface 35 of the disk, followed by a section 49 having an angle greater than the lead-in angle of lead-in section 47 and extending to top surface 27 of the disk 23.

The disk 23 may rotate clockwise in the direction of arrow 50, as shown in FIG. 6. As the disk rotates, material which is being mixed, blended, or masticated is drawn downwardly through the openings 29 by a pumping action, and urged outwardly towards the periphery of the disk. The material is then forced through mixing teeth 31, 33 back towards the top surface 27 of the disk 23. The angular inclination of mixing teeth 31, 33 ensures a variety of edges in contact with the material such that effective mixing occurs. In operation, there are additional material flow movements, for example, some material may slide laterally from the top surface 27 of the disk down through the mixing teeth 31, 33.

If disk 23 must be rotated in a counterclockwise direction, for example, because the rotation of the shaft to which it is to be attached cannot rotate in a clockwise direction, then disk 23 may be made in a left-hand embodiment in which the orientation of the openings are reversed as compared to openings 29 of disk 23, which is a right-hand disk.

Figure 8:
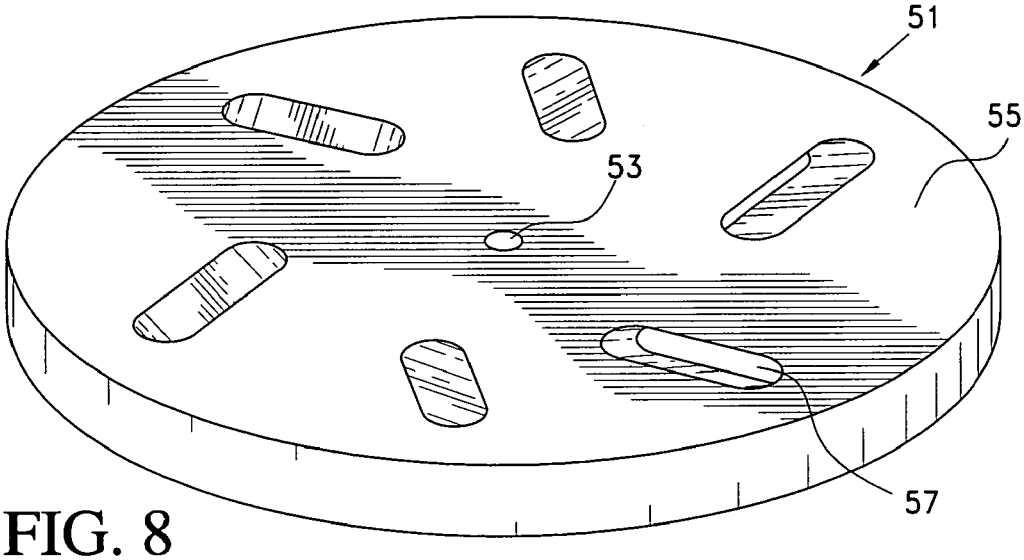
FIG. 8 is a perspective view of a third embodiment of a blade according to the present invention.
Figure 9:
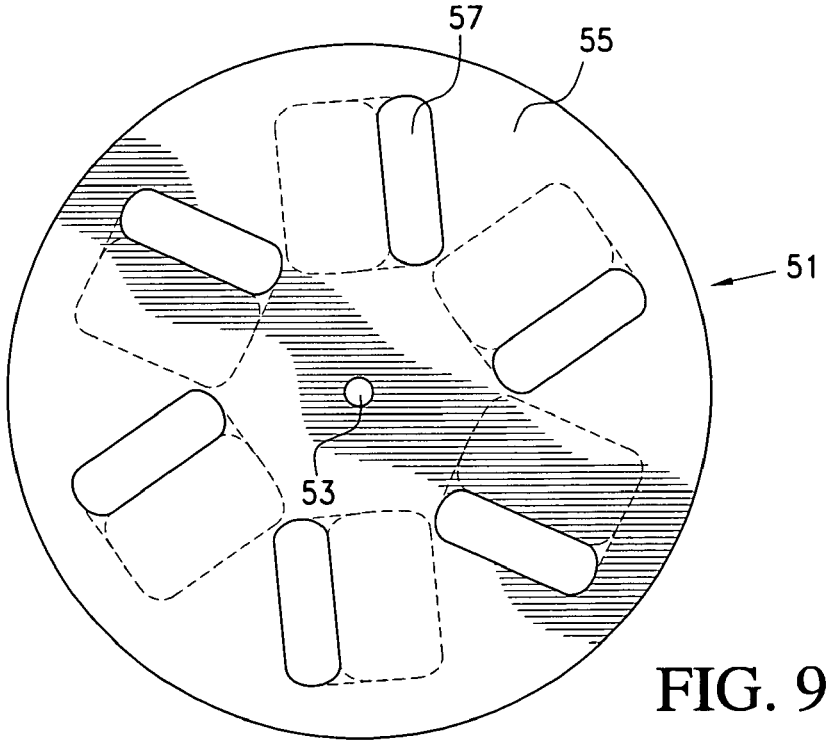
FIG. 9 is a top view of the blade shown in FIG. 8.

FIG. 8 shows a mixing blade according to a third embodiment of the present invention. The mixing blade comprises a disk 51 having a opening 53 for mounting on a shaft. The top surface 55 has circumferentially-spaced and radially-aligned openings 57 extending from top surface 55 through to bottom surface 59. Disk 51 has no mixing teeth extending from its circumferential edge. FIG. 9 shows a view of the top surface 55 of disk 51.

A blending apparatus according to the present invention may comprise one or more disks mounted on a rotatable shaft. Depending upon the depth of the batch of material to be mixed, blended, or masticated, two or more disks may be needed to provide adequate surface movement of the batch of material.

Figure 10:
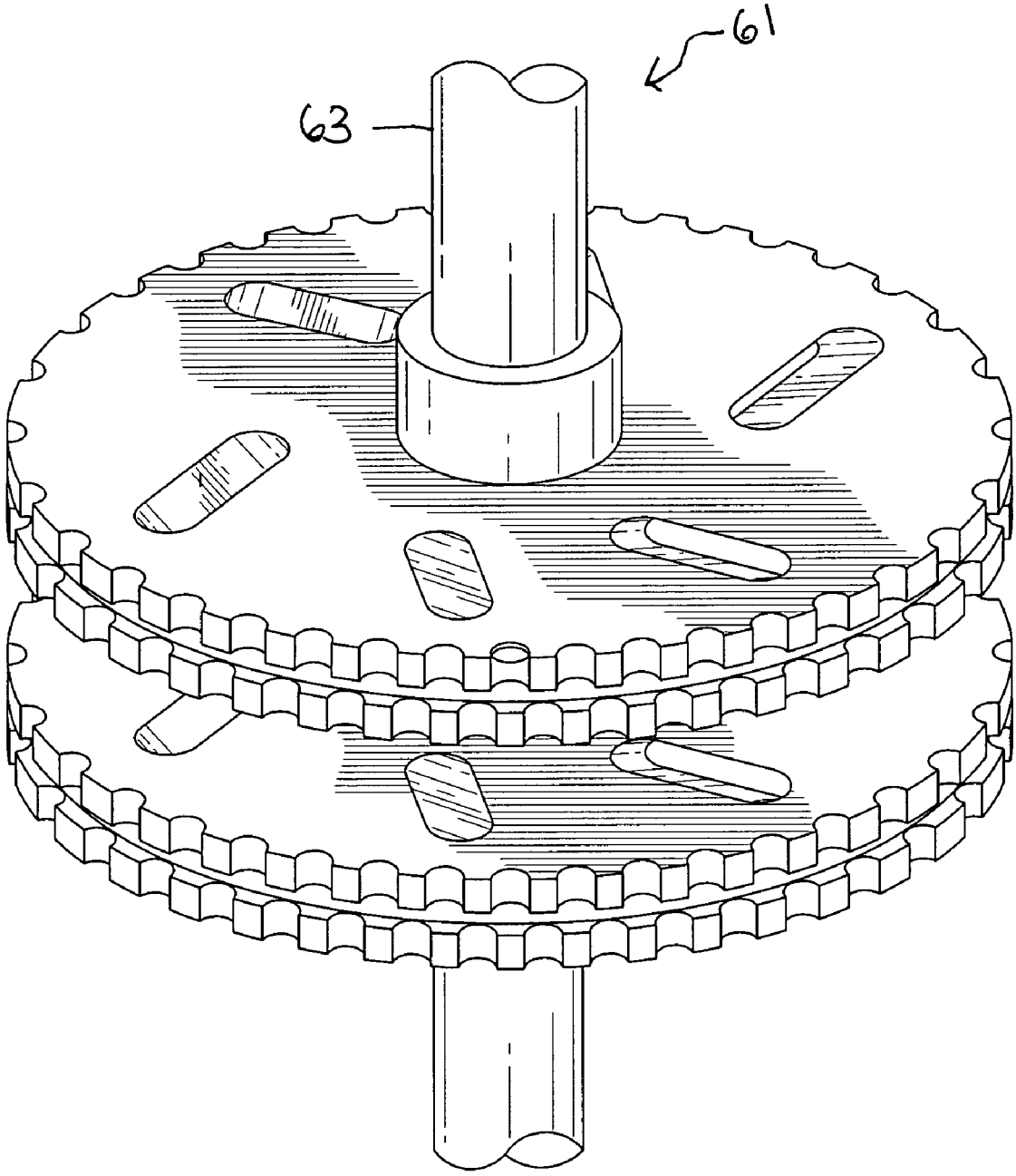
FIG. 10 is a schematic representation of a blending apparatus having two blades according to the present invention.

Thus, in an embodiment according to the present invention, a blending apparatus 61 may include two blades mounted on a single rotatable shaft 63 in an opposed mutually-spaced relationship, with a mixing space between the blades, as shown in FIG. 10. The two disks may both be right-handed and rotate clockwise. Alternatively, the two disks may be left-handed and rotate counterclockwise.

In another embodiment, the blending apparatus may have a top disk that is right-handed and a bottom disk that is left-handed. As the bottom left-hand disk is rotated clockwise, the material being mixed, blended, or masticated will be pumped upwards through the openings of the left-hand disk, and material will be pumped downwards through the openings of the top right-hand disk. This configuration allows for intense mixing in a zone between the two disks, for example, when sparging a gas into a material.

The blade according to the present invention may be attached to a rotatable shaft in any appropriate or conventional manner. In embodiments, the blade may be attached onto the end of the shaft, for example, by a bolt or by driving pins extending between the end of the shaft and through a disk. Alternatively, the blade may be attached to a rotatable shaft via a hub, for example, by radial locking screws engaged through the hub and clamping against a surface of the rotatable shaft. The hubs, screws, and driving pins of U.S. Pat. Nos. 3,606,577 and 4,813,787 are incorporated by reference herein in their entirety.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What is claimed is:

1. A blade for mixing a material, comprising:

a disk comprising a plastic or composite material, said disk having a substantially flat top surface and a substantially flat bottom surface, a center opening for mounting the disk on a rotatable shaft, and a plurality of circumferentially-spaced openings extending through the disk from the substantially flat top surface to the substantially flat bottom surface, wherein each opening has two sides which extend from said top surface to said bottom surface, each of said two sides being angled with respect to an axis perpendicular to the substantially flat top surface of the disk, said angling of each of said sides extending from said top surface to said bottom surface, at least one of said sides having two differently angled sections, and said circumferentially-spaced openings being spaced inwardly away from the outer periphery of the disk, wherein material which is being mixed by the blade is drawn downwardly through the circumferentially-spaced openings.

2. A blade according to claim 1, wherein the openings are located at a common radial distance from a center of the disk.

3. A blade according to claim 1, wherein the disk comprises at least one material selected from the group consisting of nylon, Teflon®, polyethylene, polyurethane, polyvinyl chloride, and combinations thereof.

4. A blade according to claim 1, wherein the disk comprises a high density, high molecular weight polyethylene.

5. A blade according to claim 1, wherein said two different angled sections comprise a lead-in section having a lead-in angle with respect to the axis perpendicular to the substantially flat top surface of the disk and extending from the substantially flat top surface or the substantially flat bottom surface of the disk, followed by a section having an angle greater than the lead-in angle of the lead-in section.

6. A blending apparatus, comprising:

a rotatable shaft; and one or more blades according to claim 1 mounted on the rotatable shaft.

7. A blending apparatus according to claim 6, comprising at least two blades being mutually spaced from one another along the rotatable shaft.

8. A method of blending a material comprising mixing, blending, or masticating a material with one or more blades according to claim 1.

9. A method according to claim 8, wherein the material is at least one material selected from the group consisting of ink, paint, adhesives, chemicals, polyorethanes, sealers, slurries, grouts, and food products.

10. A method according to claim 8, wherein the material is a fluid material comprising aggregates or powders.

11. A method according to claim 8, wherein the one or more blades each comprise at least one material selected from the group consisting of nylon, Teflon®, polyethylene, polyurethane, polyvinyl chloride, and combinations thereof.

12. A blade for mixing a material, comprising:

a disk comprising a plastic or composite material, said disk having a substantially flat top surface and a substantially flat bottom surface, a center opening for mounting the disk on a rotatable shaft, one or more circumferentially-spaced openings extending through the disk from the substantially flat top surface to the substantially flat bottom surface, wherein the disk further comprises one or more sets of mixing teeth extending outwardly from a circumferential edge of the disk, said mixing teeth being within the planes of said substantially flat top surface and said substantially flat bottom surface of the disk.

13. A blade according to claim 12, wherein the disk comprises:

a first set of mixing teeth extending outwardly from the circumferential edge of the disk from the top surface of the disk; and a second set of mixing teeth extending outwardly from the circumferential edge from the bottom surface of the disk.

14. A blade according to claim 13, wherein the two sets of mixing teeth are separated by a groove running along the circumference of the disk.

15. A blade according to claim 13, wherein the first set of mixing teeth is offset from the second set of mixing teeth.

16. A blade according to claim 12 wherein a space between successive teeth is scalloped.

17. A blade according to claim 12, wherein the one or more sets of mixing teeth are angularly oriented in relation to an axis perpendicular to the substantially flat top surface of the disk.

18. A blade according to claim 17, wherein the one or more sets of mixing teeth are at an angle of less than about 45 degrees in relation to an axis perpendicular to the substantially flat top surface of the disk.

19. A blade according to claim 17, wherein the one or more sets of mixing teeth are at an angle of about 30 degrees in relation to an axis perpendicular to the substantially flat top surface of the disk.

20. A blade according to claim 17, wherein the disk comprises:

a first set of mixing teeth extending outwardly from the circumferential edge of the disk along a top surface of the disk; and a second set of mixing teeth extending outwardly from the circumferential edge along a bottom surface of the disk, wherein said first set of mixing teeth and said second set of mixing teeth are separated by a gap.

21. A blade according to claim 12, having a plurality of circumferentially-spaced openings extending through the disk from the substantially flat top surface to the substantially flat bottom surface, said circumferentially-spaced openings being spaced inwardly away from the outer periphery of the disk, wherein material which is being mixed by the blade is drawn downwardly through the circumferentially-spaced openings.

22. A blade according to claim 21, wherein each opening has two sides which extend from said top surface to said bottom surface, each of said two sides being angled with respect to an axis perpendicular to the substantially flat top surface of the disk, said angling of each of said sides extending from said top surface to said bottom surface, at least one of said sides having two differently angled sections.

* * * * *